US007117571B2

(12) United States Patent
Dilo

(10) Patent No.: US 7,117,571 B2
(45) Date of Patent: Oct. 10, 2006

(54) METHOD OF REINFORCING NON-WOVEN FABRIC WEB BY NEEDLING

(75) Inventor: Johann Philipp Dilo, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 0 days.

(21) Appl. No.: 11/388,393

(22) Filed: Mar. 24, 2006

(65) Prior Publication Data

US 2006/0174462 A1 Aug. 10, 2006

Related U.S. Application Data

(63) Continuation of application No. PCT/EP04/010026, filed on Sep. 8, 2004.

(51) Int. Cl.
*D04H 18/00* (2006.01)

(52) U.S. Cl. ..... 28/107; 28/114; 28/115

(58) Field of Classification Search ..... 28/107, 28/114, 115, 112, 108, 109, 110, 111, 113, 28/103, 165, 170; 112/80.4, 80.43, 80.41
See application file for complete search history.

(56) References Cited

U.S. PATENT DOCUMENTS

| | | | | |
|---|---|---|---|---|
| 3,859,698 | A * | 1/1975 | Okamoto et al. | 28/115 |
| 4,818,586 | A * | 4/1989 | Smith et al. | 428/198 |
| 4,851,274 | A * | 7/1989 | D'Elia | 428/113 |
| 5,458,960 | A * | 10/1995 | Nieminen et al. | 28/107 |
| 5,732,453 | A * | 3/1998 | Dilo et al. | 28/114 |
| 6,158,097 | A * | 12/2000 | Dilo | 28/114 |
| 6,159,880 | A * | 12/2000 | Schiel | 28/107 |
| 6,161,269 | A * | 12/2000 | Dilo et al. | 28/114 |
| 6,305,058 | B1 * | 10/2001 | Fehrer | 28/107 |
| 6,564,437 | B1 * | 5/2003 | Meng et al. | 28/107 |

FOREIGN PATENT DOCUMENTS

| | | |
|---|---|---|
| CH | 343 353 A | 12/1959 |
| DE | 40 28 310 A1 | 3/1992 |
| DE | 102 38 063 A1 | 3/2004 |
| EP | 1 167 604 A1 | 1/2002 |
| FR | 2 517 339 A1 | 6/1983 |
| WO | WO 94/01611 A1 | 1/1994 |
| WO | WO 00/58538 A1 | 10/2000 |

* cited by examiner

*Primary Examiner*—A. Vanatta
(74) *Attorney, Agent, or Firm*—Jansson, Shupe, Munger & Antaramian, Ltd.

(57) ABSTRACT

A system and method for reinforcing a textile web of a fiber web or a fiber fleece by needling in a plurality of directly successive steps are provided, in which the web is needed from both sides with a high needle density in an alternating manner and in the state of the needles stitched into the web is transported through a movement of the needles which extends in the longitudinal direction of the web, where each needle in a stitching-in movement grasps merely a single fiber, having a gauge of 1 to 2 dtex, from the web. By the aid of the invention very thin fleeces can be produced without damaging same during their processing.

12 Claims, 2 Drawing Sheets

METHOD OF REINFORCING NON-WOVEN FABRIC WEB BY NEEDLING

CROSS REFERENCE TO RELATED APPLICATION

Figure 1:
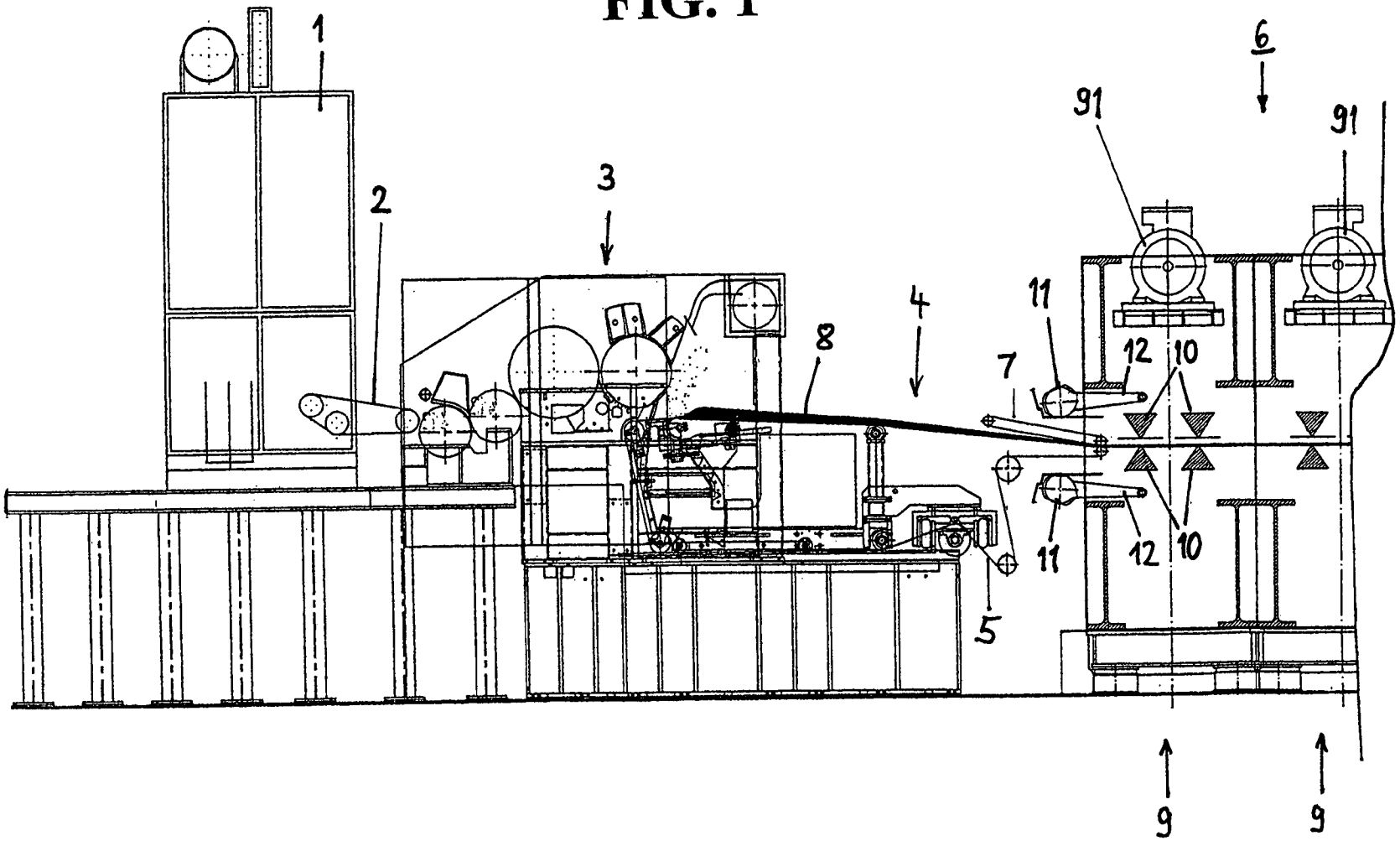

This application is a continuation of PCT application PCT/EP2004/010026, filed Sep. 8, 2004 by inventor Johann Philipp Dilo, and claims priority to German application DE 103 46 472.7, filed Oct. 2, 2003.

FIELD OF THE INVENTION

The invention relates to a method of manufacturing a textile and, more particularly, to a method of using needles for reinforcing a fiber web or fleece.

BACKGROUND

To achieve a sufficient strength in very thin fiber fleeces, as they are for instance used in the field of sanitation, a very tight compound of the fibers forming the fleece is required. So-called "needling" technology is one possible type of manufacturing technology used in producing fleeces from fiber webs and for reinforcing fleeces. Such technology generally requires that the fiber web or the fleece be needled with a very high density of stitches.

Thin fiber webs and fiber fleeces of the above-mentioned kind are very sensitive and fragile before being needled. When subjected to low mechanical load they easily lose their coherence and break. Their processing in needle looms is therefore very delicate, which is why relatively high limits were formerly set to a reduction of the surface weight of the needled products, which did not comply with the desires of the users.

Sensitivity of the processed material also resulted in the fact that the working speeds have been relatively low and the fleece web had to be processed using a very large number of needle stitches per surface unit of the product, which caused a corresponding low productivity.

Thus, it is an object of the present invention to provide a method by which a gentle processing of fiber webs and fiber fleeces is possible, which improves the production and quality of very thin and light-weight needled products.

SUMMARY OF THE INVENTION

To solve this object the invention provides a method of reinforcing a textile web of a fiber web or fiber fleece by needling in a plurality of directly successive steps, in which the web is needled alternatingly from both sides and in the state of the needles stitched into the web is moved only by a needle movement extending in the longitudinal extension of the web, each needle grasping merely a single fiber during the stitching-in movement of the needle, the fiber having a gauge of 1 to 2 dtex.

By the use of a high needle density in the individual needling steps, the invention achieves a high productivity. When using needle boards of a width of, for example, 350 to 400 mm, the method enables an equipment density of up to 40,000 needles per meter needle board length. The pitch of the needles is then, for example, 3 mm or less, which requires the use of special needles of small diameter. The production speed may reach 200 m/min at working widths of up to 6 m, only to mention examples. Light-weight products with surface weight of up to 10 g/m$^2$ and less can be manufactured, for example, of a single carding web. As a result, the fibers may be relatively fine, down to approximately 1 dtex. Fiber fibrils of less than 1 dtex can also be processed. Corresponding stitching densities may be approximately 2,500 per cm$^2$, and they may possibly also be higher. In the case of a needle equipment density of the above-mentioned kind and an effective horizontal stroke of the needles of 1 cm, the fiber fleece web must be needled by six needle boards each on both sides to achieve th mentioned stitching density.

The processing of such light-weight products, as mentioned above, is enabled by the measures of the invention, according to which the web is moved in the stitched-in state of the needles within the needle looms only by a movement of the needles which extends in the longitudinal direction of the web. Since the needles of the two needling units, which are combined in a double needle loom, alternatingly stitch into the fiber web, i.e., the working cycles of these needling units are mutually offset by 180°, an almost continuous transport of the fiber fleece web through the needles takes place by the effect of the needles only. Furthermore, this mode of operation enables a dense equipment of the needle boards, since the needles of two opposing needle boards will not collide with one another.

Thus, tension acting from external transport means does substantially not act on the web, said tension being likely to be braked by the needles in the state stitched into web. Rather, the needle units themselves are responsible for the feed of the web.

Depending on the type of processed web, a modification in length of the web by the individual needling processes may occur during operation of the needle loom. To avoid upsetting or drafts of the web between the individual needle looms, the speeds with which the individual needle looms transport the web must be adapted to one another in a suitable manner. In the case of identical horizontal and vertical strokes of the needle bars per stitching movement in the individual needle looms, the adaptation of the speed may be implemented by modification of the stitching frequencies of the individual needle looms. This solution is especially advantageous if the horizontal stroke and the vertical stroke of the needle bars are fixedly coupled with one another. However, it is also possible, with the horizontal and vertical strokes of the individual needle looms being identical, to make the stitching depths of the needles different, since thereby the time period during which the needles are stitched into the web and transport same by the horizontal movement of the needles is influenced, which has a certain effect on the transport stroke in the horizontal direction per needle stitch. If needle looms of the type described in EP 0 892 102 B1 are used, the horizontal stroke per needle stitch can to a large extent be influenced by a respective control of the needle looms.

The co-movement of the needles with the web in the stitched-in state of the needles is known from DE 196 15 697 A1. There, said co-movement has the aim to avoid a deterioration of the surface of the web, which could be caused by a draft if the transport speed of the fiber fleece by the needle loom is too high. The speed of the horizontal drive component of the needle bar is adapted to the supply speed at which the web of supply, and draft means is moved through the needle loom. By comparison, the present invention utilizes the oscillating needle movement components extending in the longitudinal direction of the web to actively transport the web without the need of further transport means. By use of the invention, not only single-layer but also multi-layer fiber fleece webs directly supplied by the carding device can be reinforced to form a fleece. In addition, it is also possible to reinforce cross-lapped fleeces by using the present method. Aerodynamically laid fiber webs, which are possibly very thin, can also be reinforced by the present needling method.

The fibers may for instance be cotton fibers, staple lengths of 20 mm to 40 mm can also be taken into consideration, as well as endless fibers of spunbonded fleeces, and smooth fibers and textured fibers may form the webs which may be processed by the aid of the invention.

When processing the webs, needles are used whose notches are so fine that they grip a single fiber only of a gauge of 1 to 2 dtex. Such a needle for instance has a shaft diameter of 1.85 mm and reduces its diameter across its length in two steps to 0.5 mm. The notch depth of the needles is about 0.02 mm, and only one notch is formed at an edge of the needle. Since only a single fiber is pressed by the needle into the fleece and the needle has an extremely small diameter, stitching holes do not remain visible. By this reason and due to the high stitching density, a mark-free surface of the needled product is achieved having a high abrasion resistance.

The distance of the notches from the needle tip shall preferably be small to be able to operate at a small needle stroke. An exemplary preferred distance between the notch and the needle tip is 2 mm. A small needle stroke allows greater working speeds. It can also operated with fork needles or crown needles, e.g. with fork widths and fork depths of 2/100 mm. The needles may have standard lengths of 2.5, 3 or 3.5 inches, they may possibly also be shorter which is in favor of their stability and the weight reduction. A weight reduction is also advantageously enhanced if the needles consist of plastics. A possibly small diameter of the needle shaft improves the strength of the needle since then more board material remains at an identical needle equipment density.

Since a high needle equipment density may cause the needle boards to become very heavy, needles of plastics can also be taken into consideration whose weight is approximately ⅛ of the weight of steel needles. To prevent wobbling of the needle boards on the needle bars carrying same, the needle boards may be attached at the needle bar in a pre-tensed manner under small elastic deformation, as described, for example, in DE 102 38 063 A1. Such technology also enables the use of very wide needle boards.

It may also be advantageous to utilize a lamellar downholder, which consists of a slotted plate at which a plurality of lamellae arranged in parallel transversely to the longitudinal extension of the plate are formed. In this manner a downholder plate can be realized, which on the one hand has a small thickness in the slot area and which is not very prone to clog by fiber flight, but which on the other hand has a great stability at low weight. With lamellae directed towards the fleece web to be needled, this downholder may also be used in reversed fashion, such as by use as a stitching support. Such a downholder complies with the fact that due to the low needle shaft diameter the needles tend to bend more than thick needles. A lamellar downholder facilitates threading of the needles into the slots of the plate carrying the lamellae or even makes threading completely dispensable if the needles do not leave the slots in the plate during their entire movement stroke.

An alternative to the use of a plurality of needle looms disposed one behind the other and through which a fiber fleece is successively passed, is a system operative to pass the fleece several times back and forth through a single needle loom and to process fleece in such several stages by using this needle loom, wherein the needle boards can be changed between the individual cycles, if it shall be needled differently in the different processing stages, for example with different needles and different needling equipment densities.

By the use of the present method, fleeces that are smooth on both sides can be manufactured, wherein the stitching depths of the needles may decrease from processing step, i.e. needling unit, to processing step, i.e. the next needling unit. Thus, the fibers, needled by the needles through the needle web and which project from the web on the side opposite the stitching side, are pushed back into the web through the needling from the other side of the web. As a result, and by the aid of the step-wise reduction of the stitching depth, it can finally be achieved that fibers don't project anymore from the web. The double-needling technique, in which, in a needling zone, the web is needled either simultaneously or alternatingly from both sides, effects a doubling of the stitching depth on small spade.

In another aspect, it is also possible to produce hairy fleeces in which fibers project on one side. Such fleeces may, for example, be used for laminating onto a support, wherein the hairs promote the fixing of the fleece on the support.

Furthermore, it is possible by the aid of the invention to manufacture light fleeces with a structured surface, such as wiping cloths which have a pattern of holes stitched therein. Such wiping cloths are favored in households because of their capability to absorb dirt. For this purpose only one respective working process, with suitable smooth needled of an enlarged shaft diameter and a small equipment density of the needle board, must be introduced into the process. Due to the resilient return ability of the fibers, which causes a closing of the holes generated, such a process may be carried out in several stages with needles having a gradually increasing diameter, wherein the alignment of the holes of the semi-finished product with respect to the needles of the successive processing stage must be taken into consideration. By the aid of modern synchronization means this can easily be achieved. The use of a brush belt as a stitching support, which is guided through all processing stages, is also advantageous in this case, since the fleece favorably adheres on the brush belt and thus keeps its position on the support. After forming the holes, a thermal fixing may take place in that the perforated material is conducted through a rotary sieve furnace or through a flat belt drying furnace to achieve a thermo-fusion of the fibers at their intersecting points if they consist of a suitable material, e.g. a thermoplastic material.

Other structures and methods may be utilized. The needling on a grate or on a slotted plate or lamellar plate as stitching support, particularly by using needles with several notches per edge or several edges with notches and a higher notch depth, enables a structure of the fleece that takes place on both sides, if it is needled from both sides of the fleece. Fiber bundles are pulled or pushed out of the pre-reinforced fleece and are transported to the fleece surface. If a multi-arrangement of needle looms is used, this structuring is carried out in the last needle looms or the last needle loom of the line of needle looms or in a separate working step within a single loom, which is operated outside the machine aline for the purpose of patterning and structuring.

Depending on the feed of the web or per stroke and depending on the needle arrangement in the needle board, many different known patterns may be manufactured, such as longitudinal strips, transverse strips, diagonals or stitching patterns, etc.

It is important that at least the horizontal drives, that are associated with the different needle zones, are independent of one another, so that an adaptation to different transport speeds, which are caused by shortenings and prolongations of the web, may be achieved. If a synchronous vertical drive of all needle bars is not taken into consideration, which must be preferred in the sense of a possibly jerk-free transport of the fiber fleece web through the device, it can also be taken into consideration to influence the transport speeds that are caused by the individual needle looms by changing the stroke frequencies of the individual needle looms.

The foregoing summary does not limit the invention, which is defined by the attached claims. Similarly, neither the Title nor the Abstract is to be taken as limiting in any way the scope of the disclosed invention.

BRIEF DESCRIPTION OF THE DRAWING FIGURES

Figure 2:
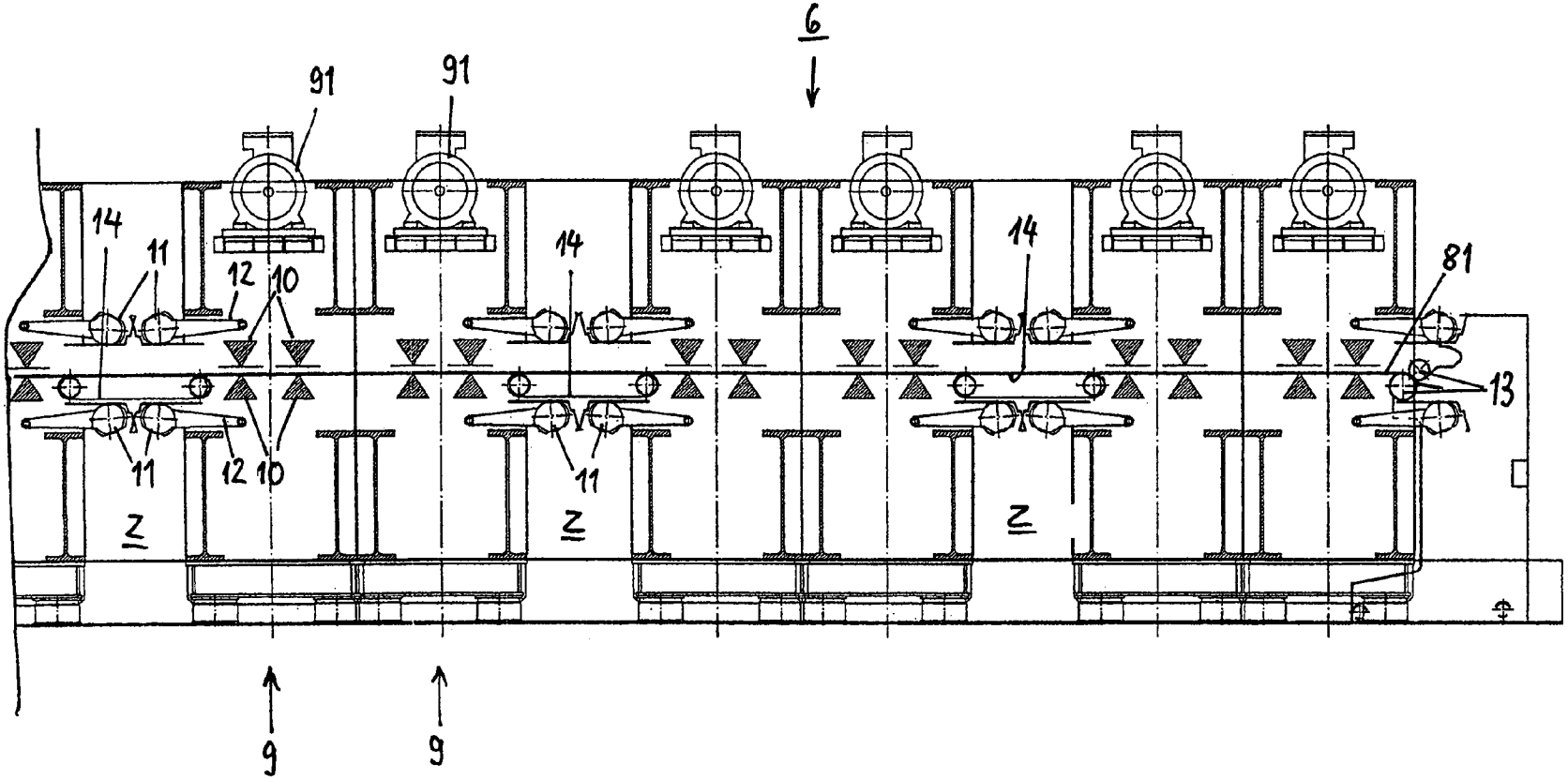

FIGS. 1 and 2 in combination show an installation for manufacturing a needled fiber fleece web, wherein:

FIG. 1 shows an aerodynamic fleece former with supply, infeed and pickup, a transfer means and the inlet portion of a multi-stage needling installation; and, FIG. 2 shows further needle looms of a needling installation.

DETAILED DESCRIPTION OF PREFERRED EMBODIMENTS

An exemplary system and method will now be described with reference to the device for reinforcing a fleece web, as shown in the drawing figures.

FIG. 1 shows an aerodynamic fleece former with supply, infeed and pickup, a transfer means and the inlet portion of a multi-stage needling installation, whereas FIG. 2 shows further needle looms of a needling installation. Instead of an aerodynamic fleece former, a roller card, a card or other web or fleece generator may be provided.

The installation of FIGS. 1 and 2 includes a fiber supplier 1, which is connected via an infeed 2 with an aerodynamic fleece former 3. From the fleece former 3 a transfer means 4, which includes an endlessly revolving transport belt 5, leads to the inlet portions of a needling installation 6, which includes a plurality of needle looms. The transport belt 5 is confronted in the inlet area of the needling installation 6 with an endlessly revolving compression belt 7, which serves for compressing a fiber fleece web 8 discharged from the roller card 3 and disposed on the endlessly revolving transport belt 5.

A plurality of double needle looms 9 are arranged within the needling installation 6, with the needle bars 10 alternatingly needling the fiber fleece web 8 from top and being schematically shown by hatched triangles. The needle bars 10 each carry a needle board densely equipped with needles, or a needle board group (not shown) densely equipped with needles. Only the drive motors 91 for the vertical stitching drive as well as horizontal drive units 11 of the needle looms 9 are schematically shown, such horizontal drive units 11 being coupled to the needle bars 10 through connecting rods 12 to provide the needle bar with a horizontal reciprocating movement component extending in parallel to the extension direction of the fiber fleece web 8. The coupling between the connecting rods 12 and the needle bars 10 is not shown for reasons of clarity. For details, reference can be made, by way of example, to the aforementioned DE 196 15 697 A1 and to EP 0 892 102 B1, wherein the latter also discloses means by which the infinitely variable change of the stroke size of the horizontal movement of the needle bars may be adjusted elegantly. In this context it must be noted that it is advantageous if the stitching depth of the needles can also be adjusted, since this determines the dwelling time during which the needles are in the state stitched into the fiber fleece. For further explanations in this context, reference again is made by example to DE 196 15 697 A1.

The arrangement of the needle bars 10 and their drives 11 and 91 is identical in all needle looms 9. The vertical drives of the individual needle looms 9 may be independent of one another and may also be controllable independent of one another to be able to individually influence the stroke frequencies, by means of which the transport speeds of the fiber fleece web at the individual needle looms can be varied. However, they can also be driven synchronously with one another, particularly by a common drive means, which helps avoiding stretching and upsetting deformations of the fiber fleece web within needling installation. But then the horizontal drives should be adjustable individually in their stroke size to enable that local transport speed adaptations be made.

On the outlet side of the needle loom installation 6 an outlet roller pair 13 is arranged, which discharges the ready worked fiber fleece web, which is now designated as final product by 81, from the installation.

In the needle loom installation 6, two double needle looms 9 may be combined in one common machine frame to form a twin unit, which has common upper and lower stitching supports (not shown) for the web to be processed. All upper needle bars, i.e., the upper needle bar groups of the twin arrangement, may be driven commonly, and the same applies to all lower needle bars.

Since the horizontal drives 11 for the needle bars 10 require a certain space, the gaps Z between adjoining twin units, where the horizontal drives are accommodated, are each bridged by endlessly revolving transport belts 14, which support the processed fiber fleece web 8 from below so that it does not sag by its own weight and be thereby possibly stretched in an undesired manner. As an alternative, smooth support plates of a small surface friction can be taken into consideration over which the fiber fleece web can easily slip.

Since the web 8 is needled from both sides and the invention therefore uses double needle looms in which in a needling zone two needle units needling against one another oppose and whose needles alternatingly stitch into the fiber fleece web, the stitching supports on both sides of the fiber fleece web, against which the latter is pressed by the needle movement, are lamella grates with longitudinally extending lots, or slotted plates, whose slots enable the horizontal movement of the needles for the transport of the fiber fleece web 8 in the state stitched into same. Details are not shown, but reference may be made in this respect to the documents mentioned above, again by example. The use of lamella grates is known per se in the needling technology, particularly when forming pole loops on needle felts that are, for instance, used as flooring.

The needles may be arranged on the needle boards in packages, wherein packages are offset seen in the longitudinal direction transversely with respect to one another by less than one needle pitch to increase the stitching density on the fiber fleece web. The slots in a slot plate used as stitching support must then be offset as well with respect to one another in the transverse direction. It is also possible to adjust the lateral guide on he individual needle looms in adaptation to one another in a manner that the stitches generated by the needles of a following needle loom are offset in the fiber fleece web in the transverse direction with respect to the stitches which are generated in the same fiber fleece web by the needles of a preceding needle loom.

The horizontal strokes, which the individual horizontal drives 11 must carry out, must be adjustable depending on the properties of the fiber fleece web. As already mentioned, EP 0 892 102 B1 discloses means by which the horizontal stroke can infinitely be varied also during operation of the machine. As an alternative, a change of the stroke frequency can also be implemented. The stretching or shrinking of the fiber fleece web 8 possible occurring by the processing can, for instance, be determined in a contact-less manner by the aid of electronic cameras and autocorrelation of the images taken by same, and by the aid of these images the horizontal drives can be set. The means required for this purpose are not shown in the drawing figures for reason of clarity. It is clear that such means can be provided on each needle loom where the fiber fleece web may be subjected to changes, wherein a central control unit may be provided for the entire installation.

While the principles of the invention have been shown and described in connection with specific embodiments, it is to be understood that such embodiments are by way of example and are not limiting. Consequently, variations and modifications commensurate with the above teachings, and with the skill and knowledge of the relevant art, are within the scope of the present invention. The embodiments described herein are intended to illustrate best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A method of reinforcing a textile web consisting of a fiber web or fiber fleece, the method comprising needling said web in a plurality of steps, in which the web is needled alternatingly from both sides and in a state of the needles stitched into the web is moved in a longitudinal extension of the web exclusively by a movement of the needles which extends in the longitudinal extension of the web, wherein said web is needled in a plurality of directly successive steps each with a high needle density, wherein each needle in a stitching-in movement grasps merely a single fiber having gauge of 1 to 2 dtex from the web.

2. The method as claimed in claim 1, in which a stitching depth of the needles decreases from step to step.

3. The method as claimed in claim 1, in which in at least late steps of the method a stitching depth of the needles on a first side of the web is smaller than a stitching depth of the needles on a second side of the web.

4. The method as claimed in claim 1, in which the web consists of a single-layered or multi-layered card non-woven web.

5. The method as claimed in claim 1, in which vertical stitching movements of needle bars are synchronized with one another.

6. The method as claimed in claim 1, in which the web is supported between at least some of the needling steps by smooth rest surfaces or by support surfaces moved in unison with the web and contacted by the web.

7. The method as claimed in claim 1, in which the web is needled in a plurality of successive steps by a plurality of double needle looms arranged in a transport direction of the web.

8. The method as claimed in claim 1, in which horizontal movement components of the needles in the individual steps are differently large.

9. The method as claimed in claim 1, in which permanent holes are generated in the needled web by the aid of needles, and the web is subsequently subjected to a fixing process.

10. The method as claimed in claim 1, in which needles made from plastics are used.

11. The method as claimed in claim 1, in which needles having a notch depth of 0.02 mm are used.

12. The method as claimed in claim 1, wherein the needles are arranged at a needle board in groups which are transversely offset with respect to one another seen in a transport direction of the web by about less than a needle pitch.

* * * * *